US009901985B2

(12) United States Patent
Makita et al.

(10) Patent No.: US 9,901,985 B2
(45) Date of Patent: Feb. 27, 2018

(54) METHOD FOR MANUFACTURING SILVER PARTICLES

(71) Applicant: Tanaka Kikinzoku Kogyo K.K., Tokyo (JP)

(72) Inventors: Yuichi Makita, Tsukuba (JP); Yuusuke Ohshima, Tsukuba (JP); Hidekazu Matsuda, Tsukuba (JP); Noriaki Nakamura, Tsukuba (JP); Junichi Taniuchi, Tsukuba (JP); Hitoshi Kubo, Tsukuba (JP)

(73) Assignee: TANAKA KIKINZOKU KOGYO K.K., Tokyo (JP)

( * ) Notice: Subject to any disclaimer, the term of this patent is extended or adjusted under 35 U.S.C. 154(b) by 197 days.

(21) Appl. No.: 14/891,725

(22) PCT Filed: May 20, 2014

(86) PCT No.: PCT/JP2014/063280

§ 371 (c)(1),
(2) Date: Nov. 17, 2015

(87) PCT Pub. No.: WO2014/189024

PCT Pub. Date: Nov. 27, 2014

(65) Prior Publication Data

US 2016/0121404 A1 May 5, 2016

(30) Foreign Application Priority Data

May 24, 2013 (JP) ..... 2013-109523

(51) Int. Cl.
*B22F 9/30* (2006.01)
*B22F 1/00* (2006.01)

(52) U.S. Cl.
CPC ..... *B22F 9/30* (2013.01); *B22F 1/0018* (2013.01); *B22F 2301/255* (2013.01);
(Continued)

(58) Field of Classification Search
None
See application file for complete search history.

(56) References Cited

U.S. PATENT DOCUMENTS 7,291,292 B2 * 11/2007 Ittel ..... B22F 1/0096 252/500
2007/0003603 A1 * 1/2007 Karandikar ..... A01N 59/16 424/443
2015/0231698 A1 * 8/2015 Kurihara ..... B22F 1/02 252/514

FOREIGN PATENT DOCUMENTS

JP 2008-214695 A 9/2008
JP 2009-144197 A 7/2009
(Continued)

OTHER PUBLICATIONS

PCT, International Search Report PCT/JP2014/0063280, dated Jul. 1, 2014.

*Primary Examiner* — George Wyszomierski
(74) *Attorney, Agent, or Firm* — Orrick, Herrington & Stucliffe LLP; Joseph A. Calvaruso

(57) ABSTRACT

The present invention provides a method for producing silver particles, the method capable of adjusting the particle diameter to be within the range of several tens of nanometers to several hundreds of nanometers and also producing silver particles with a uniform particle diameter. The present invention relates to a method for producing silver particles by heating of a reaction system containing a thermally-decomposable silver-amine complex precursor, including a process of producing a silver-amine complex, a process of adding an organic compound having an amide (carboxylic amide) as a skeleton to a reaction system, and a process of heating the reaction system, in which a water content in the reaction system before the heating is 20 to 100 parts by weight relative to 100 parts by weight of the silver com-
(Continued)

pound. The present invention can produce uniform silver particles while the particle diameter is controlled.

20 Claims, 9 Drawing Sheets

(52) U.S. Cl.
CPC ... *B22F 2304/054* (2013.01); *B22F 2304/056* (2013.01); *B22F 2999/00* (2013.01)

(56) References Cited

FOREIGN PATENT DOCUMENTS

| | | | |
|---|---|---|---|
| JP | 2010-500475 | A | 1/2010 |
| JP | 2010-265543 | A | 11/2010 |
| JP | 2012-018957 | A | 1/2012 |
| JP | 2014-34602 | A | 2/2014 |
| JP | 2014-40630 | A | 3/2014 |
| WO | WO 2010/119630 | A1 | 10/2010 |

* cited by examiner

No.1

No.2

No.3

No.4

No.7

No.5

No.2

No.8

No.9

No.13

No. 10

No. 11

No.12

No.19

No.20

No.21

No.22

No.24

No.22

No.23

No.25

No.2

No. 2

No.29

No.22

No.30

METHOD FOR MANUFACTURING SILVER PARTICLES

TECHNICAL FIELD

The present invention relates to a method for producing silver particles, and particularly to a method for producing silver particles with a uniform particle diameter in production of silver particles having a particle diameter within the range of several tens of nanometers to several hundreds of nanometers while the size of silver particles is controlled.

BACKGROUND ART

Silver (Ag) is one of precious metals and is known to be usable as a metal for accessories from a long time ago. Moreover, since silver has unique characteristics such as catalyst action and antibacterial action as well as excellent conductivity and optical reflectivity, silver is a promising metal used in various industrial applications such as electrode or wiring materials, materials for reflective films, catalysts, and antibacterial materials. As a utilization form of silver used for various applications, there is a case where silver particles are dispersed or suspended in an appropriate solvent. For example, in the case of silver used for formation of electrodes or wirings of wiring boards mounted on electronic components such as semiconductor devices, silver particles are formed to have a paste form, this metal paste is applied and calcined so that it is possible to form desired electrodes or wirings.

A liquid phase reduction method is a generally known method for producing silver particles. In the method for producing silver particles according to the liquid phase reduction method, a silver compound serving as a precursor is dissolved in a solvent and a reducing agent is added to the resultant solution, thereby precipitating silver. At this time, it is general to add a compound called a protective agent in order to suppress the aggregating and coarsening of silver particles to be precipitated. Since the protective agent is bonded to the silver particles which have been precipitated by reduction and suppresses the contact between the silver particles, the protective agent prevents the aggregation of silver particles.

Regarding the method for producing silver particles according to the liquid phase reduction method, it is possible to efficiently produce silver particles by adjustment of the silver compound concentration in the solvent and the type and added amount of the reducing agent, and appropriate selection of the protective agent. However, the silver particles to be produced according to the liquid phase reduction method tend to relatively increase in a particle diameter, and the particle size distribution tends to vary depending on the concentration gradient of a reaction material in a solvent.

In this regard, as a method for producing silver particles alternative to the liquid phase reduction method, a thermal decomposition method of a silver complex is reported (Patent Document 1). This method basically uses characteristics of a thermally-decomposable silver compound such as silver oxalate ($Ag_2C_2O_4$), and this method is to obtain silver particles in such a manner that a complex is formed by use of this silver compound and an organic compound serving as a protective agent and the complex is heated as a precursor. In Patent Document 1 described above, silver particles are produced by thermal decomposition in such a manner that an amine as a protective agent is added to silver oxalate to form a silver-amine complex and the silver-amine complex is heated at a predetermined temperature. This thermal decomposition method allows for production of silver fine particles with an extremely minute diameter of several nanometers to a ten and several nanometers and also to obtain silver fine particles with a relatively uniform particle diameter.

RELATED ART DOCUMENT

Patent Document

Patent Document 1: JP 2010-265543 A

SUMMARY OF THE INVENTION

Problems to be Solved by the Invention

As described above, the utilization field of the silver particles is on an expanding trend. For this reason, there is a demand for silver particles with a medium degree of about several tens to several hundreds of nanometers depending on use of the silver particles as well as silver particles with minute particle diameter of 10 nm or less. In order to meet this demand, it is necessary to provide a production method capable of controlling a particle diameter of silver particles to be produced in a wide range of the particle diameter. However, the above-described conventional method for producing silver particles is not sufficient from the viewpoint of particle diameter control. In the liquid phase reduction method, it is possible to produce only large silver particles (about several of micrometers). In addition, the thermal decomposition method is suitable for producing minute silver particles, but this method is difficult to cope with the case of producing silver particles with a target particle diameter, that is, a medium degree of about several tens of nanometers to several hundreds of nanometers.

Furthermore, in order to expand future utilization range of silver particles, the silver particles are required to cope with various different average particle diameters for each purpose and to have reduced variation in particle diameter of silver particles to be produced. In this regard, the silver particles obtained by the thermal decomposition method have a uniform particle diameter to some extent since the particle diameter of particles to be obtained is dependent on the type of the silver compound. Meanwhile, it is difficult to adjust the particle diameter of silver particles particularly with a large average particle diameter. For example, in the case of using a silver oxalate-amine complex as the silver compound, it is possible to obtain silver fine particles with a particle diameter of around a ten and several of nanometers; however, on the occasion of the production of silver particles with a larger particle diameter (for example, an average particle diameter of several tens of nanometers or more), it is not possible to obtain silver particles with a uniform particle diameter.

In this regard, the present invention provides a method for producing silver particles, the method capable of adjusting the particle diameter to be within the range of several tens of nanometers to several hundreds of nanometers and also producing silver particles with a uniform particle diameter.

Means for Solving the Problems

As a method to solve the problems, the present inventors first conducted examination based on a method for producing silver particles by a thermal decomposition method. This is because they thought that, in the thermal decomposition method, it is possible to produce silver particles with a relatively uniform particle diameter and the adjustment of the particle diameter is easier as compared to the liquid phase reduction method, as described above.

In this regard, the present inventors considered a generation mechanism of silver particles according to the thermal decomposition method with reference to a general LaMer model that is a precipitation mechanism of single-dispersed fine particles in a closed solution system, and the details are as follows. Incidentally, a case where a silver oxalate complex coordinated with hexylamine is thermally decomposed to produce silver particles is herein exemplified. When the hexylamine-coordinated silver oxalate complex is heated at a constant heating rate, the "nucleation" of silver starts at a temperature (80 to 90° C.) slightly lower than a decomposition temperature (about 110° C.) of the complex. Then, when heating is continued such that the temperature increases to the temperature near the decomposition temperature (90° C. to 110° C.), decomposition of the complex proceeds on the surface of the generated nucleus to achieve "nucleus growth." At this time, "new nucleation" different from the nucleation described above also occurs. Thus, silver particles are generated by the nucleation and the nucleus growth according to the heating up to the decomposition temperature.

When such a generation mechanism of silver particles is taken into consideration, it is assumed that the heating rate affects a change in particle diameter of the silver particles to be generated. That is, it is considered that a faster heating rate results in generation of silver particles with a small particle diameter, but a decrease in heating rate results in generation of silver particles with a large particle diameter. However, generally, there is the tendency as described above in the case of adjustment of the heating rate, but uniform silver particles are not easily generated without variation in particle size distribution. This is because not only the nucleus growth but also the new nucleation occurs in the heating near the decomposition temperature. In particular, as a target particle diameter of silver particles increases, it is easier to generate the new nucleus during the particles grow and variation in particle size distribution tends to increase. Thus, the generation of silver particles with a uniform particle diameter is estimated to be difficult.

In order to make the particle diameter of the silver particles uniform, there is a need that new nucleation does not occur in the stage of the nucleus growth as described above. The present inventors considered that the deviation of timing of this nucleation is derived from non-uniformity of decomposition characteristics (stability) of the complex. In this regard, the present inventors found that it is possible to uniformly precipitate silver particles with addition of a predetermined organic compound as an additive for promoting the uniformity of stability of the complex to the reaction system, and thus derived the present invention.

That is, the present invention relates to a method for producing silver particles by use of a thermally-decomposable silver-amine complex as a precursor and heating of a reaction system containing the precursor, including:

a process (a): mixing a thermally-decomposable silver compound with an amine to produce a silver-amine complex as a precursor;

a process (b): adding an organic compound, which has an amide as a skeleton, represented by the following formula to a reaction system

[Chemical Formula 1]

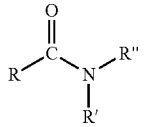

(R is hydrogen, hydrocarbon, an amino group, or a combination thereof; R' and R" are hydrogen or hydrocarbon); and a process (c): heating the reaction system, wherein a water content in the reaction system before the heating in the process (c) is 20 to 100 parts by weight relative to 100 parts by weight of the silver compound.

As described above, the present invention relates to a method for producing silver particles in which a reaction system containing a thermally-decomposable silver-amine complex serving as a precursor is heated, and is mainly characterized in that an organic compound having an amide (carboxylic amide) as a skeleton is added to the reaction system. Hereinafter, the method for producing silver particles according to the present invention including this characteristic will be described.

In the present invention, first, a silver-amine complex that is a precursor of silver particles is generated. This silver-amine complex is thermally decomposable, and a thermally-decomposable silver compound is used as a raw material of the silver-amine complex. Silver oxalate, silver nitrate, silver acetate, silver carbonate, silver oxide, silver nitrite, silver benzoate, silver cyanate, silver citrate, silver lactate, or the like is applicable.

Among the above silver compounds, silver oxalate ($Ag_2C_2O_4$) is particularly preferable. The silver oxalate can be decomposed at relatively low temperature, without use of a reducing agent, to generate silver particles. Further, since oxalate ions discharged by decomposition of the silver oxalate are removed as carbon dioxide, there is no case where impurities remain in the solution. Incidentally, since the silver oxalate is a powdered solid having explodability, silver oxalate in a wet state is preferably used by mixing of the silver oxalate with, as a dispersion solvent, water or an organic solvent (alcohol, alkane, alkene, alkyne, ketone, ether, ester, carboxylic acid, fatty acid, aromatic series, amine, amide, nitrile, or the like). When the silver oxalate is in a wet state, explodability significantly decreases, and thus handleability is facilitated. At this time, 10 to 200 parts by weight of a dispersion solvent is preferably mixed relative to 100 parts by weight of silver oxalate. However, the present invention strictly defines the amount of water in the reaction system as described below, and in the case of mixing of water, it is necessary to set the mixing amount of water to be within the range not exceeding the defined amount.

Further, as an amine used for reaction with the silver compound in the process (a), a (mono)amine having one amino group or a diamine having two amino groups are applied. The number of alkyl groups with which the hydrogen atom of the amino group is substituted is preferably one or two. That is, a primary amine ($RNH_2$) or a secondary amine ($R_2NH$) is preferable. As the diamine, preferable ones are a diamine in which at least one or more amino groups are a primary amine or a secondary amine. A tertiary amine tends to have difficulty in forming a complex with a silver compound. The alkyl group substituted with an amine is preferably a chain hydrocarbon and particularly preferably a linear alkane (saturated hydrocarbon). Among amines to which these alkyl groups are bonded, alkylamine consisting of only a chain hydrocarbon is preferable, and a primary (mono)amine consisting of one amino group and one alkyl group is particularly preferable.

The total number of carbon atoms of the alkyl group in the amine is preferably 5 to 10. The reason why there is limitation on the preferred range of the total number of carbon atoms of the alkyl group is that an amine coordinated in the silver compound affects a change in stability and decomposition temperature of the silver-amine complex to be formed and a change in particle diameter of silver particles to be generated. In the case of employing an amine having the total number of carbon atoms of less than 5, variation in particle diameter of the silver particles with a particle diameter of several tens of nanometers to several of micrometers easily increases. Further, in the case of employing an amine having the total number of carbon atoms of more than 10, the thermal decomposition of the silver-amine complex is difficult at the time of synthesis and a large amount of unreacted products other than silver particles is likely to remain.

Preferred specific examples of the amine in the present invention include N,N-dimethyl-1,3-diaminopropane $H_2N(CH_2)_3N(CH_3)_2$, 2,2-dimethyl propylamine, n-pentylamine, cyclohexylamine, n-hexylamine, n-heptylamine, n-octylamine, n-nonylamine, and n-decylamine.

As described above, the decomposition temperature of the silver-amine complex is different depending on the type of amine (the total number of carbon atoms of the alkyl group). For this reason, in the present invention, selection of the type of amines can control the particle diameter of the silver particles. According to the configuration in the present invention, hexylamine, when employed for example, can produce silver particles with a particle diameter of 20 to 200 nm. Further, octylamine, when employed can produce fine silver particles as compared with the case of employing hexylamine and can produce silver particles with a particle diameter of 10 to 150 nm. Moreover, two or more types of amines are applicable as an amine used for reaction with the silver compound in the present invention. When two or more types of amines are employed, stable intermediate complexes are formed for each amine and silver particles with a particle diameter corresponding to the complexes can be produced. For example, in a case where hexylamine and octylamine are used in the same amount, it is possible to produce silver particles with an intermediate particle diameter relative to a particle diameter range which can be produced by use of hexylamine and octylamine.

Regarding the mixing ratio of the silver compound and the amine, a ratio ($mol_{amine\ compound}/mol_{Ag+}$) of the number of moles of an amine compound ($mol_{amine}$ compound) to the number of moles of silver ions ($Ag^+$) of the silver compound ($mol_{Ag+}$) is preferably set to be 1.6 or more. When the molar ratio is less than 1.6, there is a concern that the unreacted silver compound remains and sufficient silver particles cannot be produced. In addition, variation in particle size distribution of the silver particles easily occurs. Meanwhile, there is no need to particularly specify the upper limit value of the molar ratio (the upper limit amount of the amine), but in consideration of the purity of silver particles, the upper limit value is preferably 6 or less.

As described above, the silver-amine complex that is the precursor of the silver particles is generated by the reaction between the silver compound and the amine. An organic compound, which has an amide (carboxylic amide) as a skeleton, represented by Chemical Formula 1 is added to the reaction system formed in this way (process (b)). As described above, the organic compound has to be called a homogenizing agent for homogenizing the stability of the silver-amine complex. The homogenizing agent is an additive that homogenizes the stability of the silver-amine complex in the reaction system and aligns the timings of nucleation and nucleus growth in the decomposition temperature range of the complex so as to make the particle diameter of silver particles uniform. With addition of such a homogenizing agent, it is possible to obtain particles with a uniform particle diameter, particularly, also in the case of the silver particles with a large particle diameter (for example, 50 nm or more) in which variation in particle diameter is likely to increase.

The organic compound functioning as the homogenizing agent requires to have an amide (carboxylic amide) (N—C═O) in the skeleton of the organic compound. Regarding substituents (R, R', and R") of the amide, hydrogen, hydrocarbon, an amino group, or aminoalkyl or the like formed from a combination thereof is applicable for R, and hydrogen or hydrocarbon is applicable for R' and R". According to the present inventors, the amide of the organic compound serving as the homogenizing agent acts on the amine part of the silver-amine complex so that the complex stabilizes. Specific examples of the organic compound serving as the homogenizing agent include, in addition to urea and a urea derivative, N,N-dimethylformamide (DMF: $(CH_3)_2NCHO$), N,N-diethylformamide (DEF: $(C_2H_5)_2NCHO$), N,N-dimethylacetamide ($C_4H_9NO$), N,N-dimethylpropion amide ($C_5H_{11}NO$), and N,N-diethylacetamide ($C_8H_{13}NO$). Examples of the urea derivative include 1,3-dimethylurea ($C_3H_8N_2O$), tetramethylurea ($C_5H_{12}N_2O$), and 1,3-diethylurea ($C_5H_{12}N_2O$).

[Chemical Formula 2]

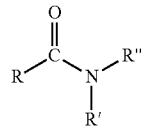

Amide (carboxylic amide)

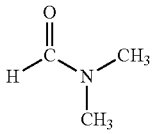

N,N-Dimethylformamide (DMF)

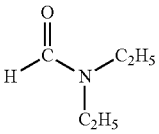

N,N-Diethylformamide (DEF)

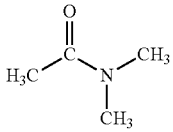

N,N-Dimethylacetamide

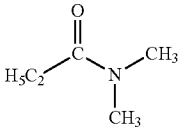

N,N-Dimethylpropion amide

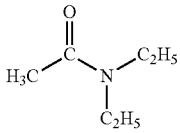

N,N-Diethylacetamide

[Chemical Formula 3]

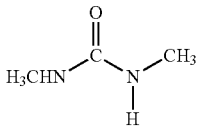

1,3-Dimethylurea

-continued

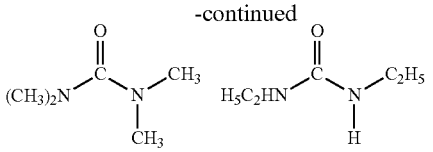

Tetramethylurea 1,3-Diethylurea

Regarding the added amount of the homogenizing agent to the reaction system, a ratio ($mol_{homogenizing\ agent}/mol_{Ag+}$) of the number of moles of the homogenizing agent to the number of moles of the silver ions ($Ag^+$) of the silver compound ($mol_{Ag+}$) is preferably set to be 0.1 or more. In the case of using a plurality of organic compounds as the homogenizing agent at the same time, the total added amount of the plurality of organic compounds is preferably set to be 0.1 or more. When the molar ratio is less than 0.1, it is difficult to make the particle diameter of the silver particles uniform. Meanwhile, the upper limit value of the molar ratio (the upper limit amount of the homogenizing agent) is not particularly limited, but in consideration of the purity of silver particles, the upper limit value is preferably set to be 4 or less with respect to silver of the silver compound. In a case where the homogenizing agent is a liquid organic compound, the homogenizing agent is preferably added without change. Further, in a case where the homogenizing agent is a solid compound such as urea, the homogenizing agent may be added while being in a solid state or in an aqueous solution state. However, in the case of using the homogenizing agent in an aqueous solution state, it is necessary to consider the amount of water in the reaction system.

In the present invention, it is necessary that a predetermined range of moisture is present in the reaction system in the heating stage of the process (c). The moisture in the reaction system serves as a buffer for the purpose of achieving an appropriate heating rate in the heating process for decomposition of the complex. In the reaction system containing the silver-amine complex and the homogenizing agent in the present invention, when the reaction system is heated without change, the decomposition of the complex occurs and it is possible to generate silver particles. However, if the heating at this time is not uniform, there is a concern that variation in particle diameter occurs. In the present invention, with active intervention of water in the reaction system and dispersion of water as a buffer for heat, a temperature difference in the reaction system becomes mild so as to make the particle diameter of the silver particles uniform.

Further, the water content in the reaction system is necessary to be within the range of 20 to 100 parts by weight relative to 100 parts by weight of the silver compound. When the amount of water is small, for example, less than 20 parts by weight, silver particles with large variation in particle diameter are produced. On the other hand, when the amount of water exceeds 100 parts by weight, the particle diameter of silver particles tends to coarsen and thus it is difficult to obtain silver particles with a target particle diameter.

The water content in the reaction system is an amount of water at a stage immediately before the heating process, and it is necessary to consider an amount of water that has been added to the reaction system up to that time. As described above, in the case of the mixing of water with the silver compound or addition of the homogenizing agent in an aqueous solution state, an amount of the water used in these cases is included in the amount of water. That is, when the water content is within the above-described range only with an amount of water originally contained in the silver compound or a homogenizing agent, it is possible to perform heating without further adjustment of the amount of water in the reaction system. On the other hand, for example, when the water content is less than the lower limit value (20 parts by weight), there is a need to adjust the amount of water, such as further adding water separately.

Incidentally, the reaction system in the present invention is acceptable if it is configured to contain a silver-amine complex, an organic compound serving as a homogenizing agent, and an appropriate range of moisture, and it is possible to produce silver particles with a uniform particle diameter without use of other additives. However, this does not mean that the addition of an additive used for further stabilizing a complex is excluded. Examples of an additive which is applicable in the present invention include oleic acid, myristic acid, palmitoleic acid, and linoleic acid. Regarding these additives, a ratio ($mol_{additive}/mol_{Ag+}$) of the number of moles of the additive ($mol_{additive}$) to the number of moles of silver ions ($Ag^+$) ($mol_{Ag+}$) is preferably set to be 0.01 to 0.1.

[Chemical Formula 4]

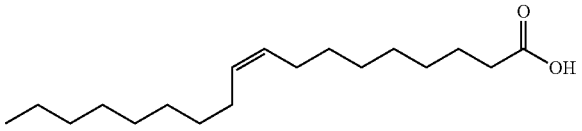

Oleic acid

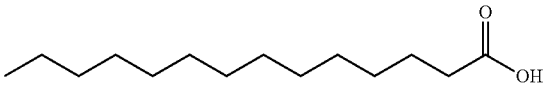

Myristic acid

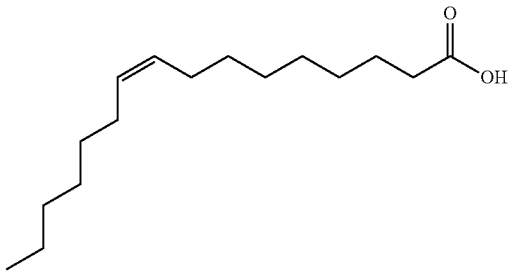

Palmitoleic acid

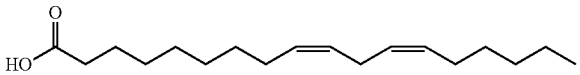

Linoleic acid

After confirmation that the water content is within an appropriate range, the reaction system is heated to precipitate silver particles (process (c)). The heating temperature at this time is preferably set to be equal to or higher than the decomposition temperature of the silver-amine complex. As described above, the decomposition temperature of the silver-amine complex varies depending on the type of amine coordinated in the silver compound. However, in the case of employing preferred amines described above, a specific decomposition temperature is 90 to 130° C.

In the heating process of the reaction system, the heating rate has an influence on the particle diameter of silver particles to be precipitated. That is, in the present invention, it is possible to control the particle diameter of silver particles by adjustment of the type of amine of the silver-amine complex serving as a precursor (type of amine used for reaction with the silver compound) and the heating rate in the heating process. Further, with use of two types of adjusting means, it is possible to produce silver particles with a target particle diameter within an average particle diameter range of 10 to 200 nm. According to the production method of the present invention, particularly, even in the case of silver particles with a relatively large particle diameter, that is, an average particle diameter of 50 to 150 nm, it is easy to obtain silver particles with a uniform particle diameter. Incidentally, the heating rate is preferably adjusted in the heating process to the above-described decomposition temperature within the range of 2.5 to 50° C./min.

Silver particles precipitates through the above-described heating process. It is possible to take out silver particles from the reaction system through washing and solid-liquid separation as appropriate. In some cases, adhesion between the silver particles may be observed, but it is possible to easily pulverize or separate the adhered silver particles. Further, it is possible to store or use recovered silver particles in a state of an ink, a paste, or a slurry in which the recovered silver particles are dispersed in an appropriate solvent, or a powdered state in which the recovered silver particles are dried.

Advantageous Effects of the Invention

As described above, the method for producing silver particles according to the present invention can easily control the particle diameter of silver particles to be generated. The silver particles to be generated at this time are uniform silver particles with a uniform particle diameter.

DESCRIPTION OF EMBODIMENTS

Figure 1:
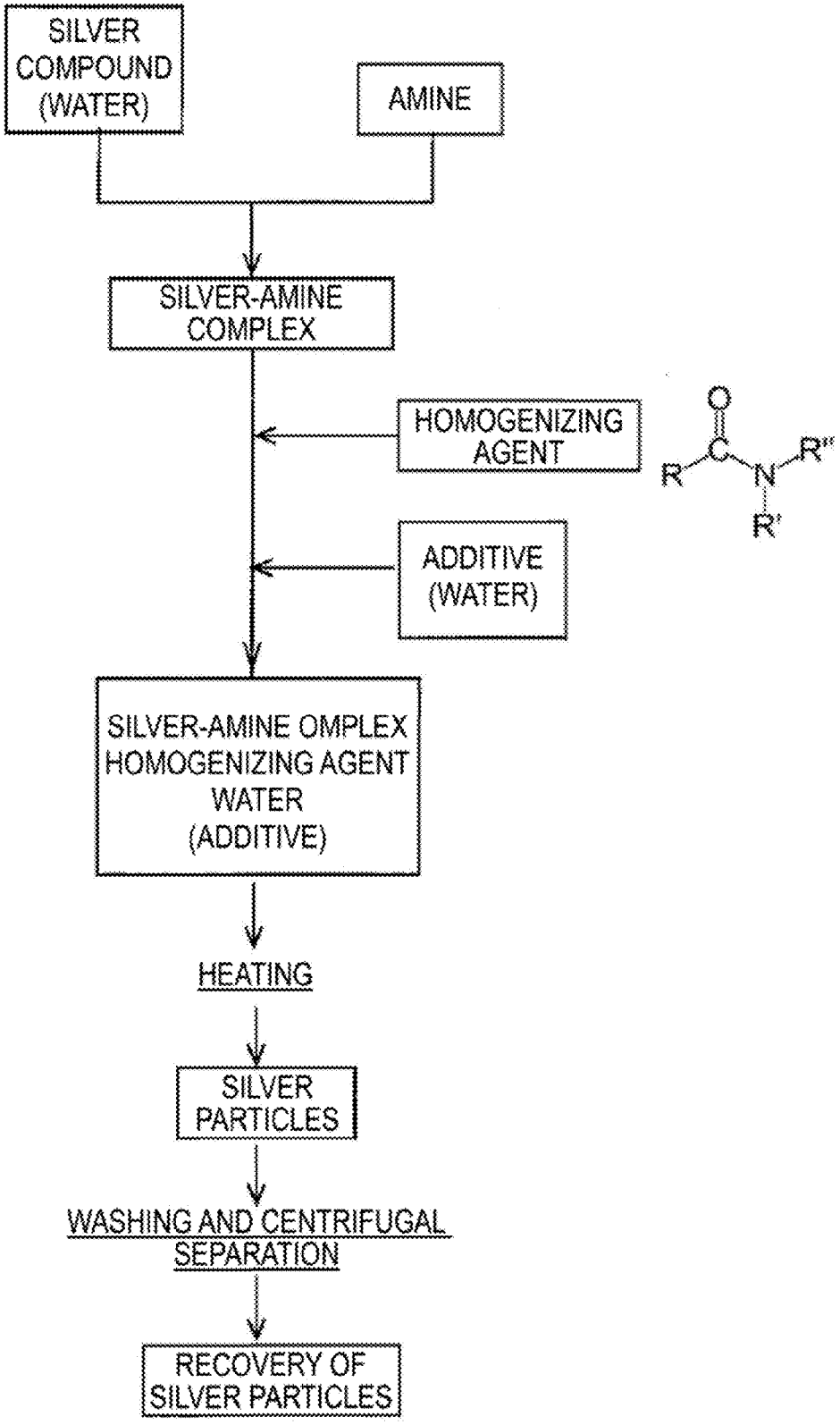
FIG. 1 is a diagram illustrating a process of producing silver particles according to this embodiment.

Hereinafter, preferred embodiments of the present invention will be described. In this embodiment, silver particles are produced while various conditions are changed according to the process in FIG. 1 and properties of the silver particles are evaluated.

In this embodiment, as a thermally-decomposable silver compound, 1.5 g of silver oxalate ($Ag_2C_2O_4$) (silver ions ($Ag^+$): 9.9 mmol) was used. Regarding the silver oxalate, silver oxalate in a dry form and silver oxalate in a wet state obtained by the addition of 0.3 g of water (20 parts by weight of water relative to 100 parts by weight of silver oxalate) were prepared. Then, n-hexylamine or n-octylamine, or the mixed amine of both of n-hexylamine and n-octylamine was added as an amine to the silver oxalate to produce a silver-amine complex. The silver oxalate and the amine were mixed at room temperature and was kneaded until the mixture became creamy and white.

Next, urea, DMF, or DEF was added, as the homogenizing agent, alone or in combination of the plurality of these homogenizing agents to the produced silver-amine complex. At this time, in the case of addition of urea, any of urea in a solid state and in a solution state added with 0.4 g of water (27 parts by weight relative to 100 parts by weight of the silver oxalate) was added. Further, after the addition of the homogenizing agent, oleic acid was added as an additive. In the reaction system thus formed, the amount of water in the reaction system varies depending on the used raw material. That is, the amount of water in the reaction system when the urea solution (27 parts by weight of water) is added to the complex produced by use of silver oxalate in a wet state (20 parts by weight) is 47 parts by weight relative to 100 parts by weight of the silver oxalate. Further, the amount of water in the reaction system when the solid urea, DMF, or DEF is added to silver oxalate in a dry state is 0 parts by weight (anhydrous state). In this embodiment, regarding the amount of water, the reaction system with the adjusted amount of water by addition of these materials other than water separately was also produced.

Then, the reaction system was heated from room temperature to decompose the silver-amine complex, and silver particles were precipitated. At this time, regarding the heating temperature, the decomposition temperature of the complex was assumed to be 110° C. and this decomposition temperature was set to be an achieving temperature. Further, the heating rate was set to be 10° C./min.

In this heating process, occurrence of carbon dioxide was confirmed in the vicinity of the decomposition temperature. The heating was continued until the occurrence of carbon dioxide was stopped, and thus a fluid having silver particles suspended was obtained. After the precipitation of silver particles, methanol was added to the reaction solution for washing, and the centrifugal separation was carried out. The washing and the centrifugal separation were performed twice, respectively.

Figure 9:
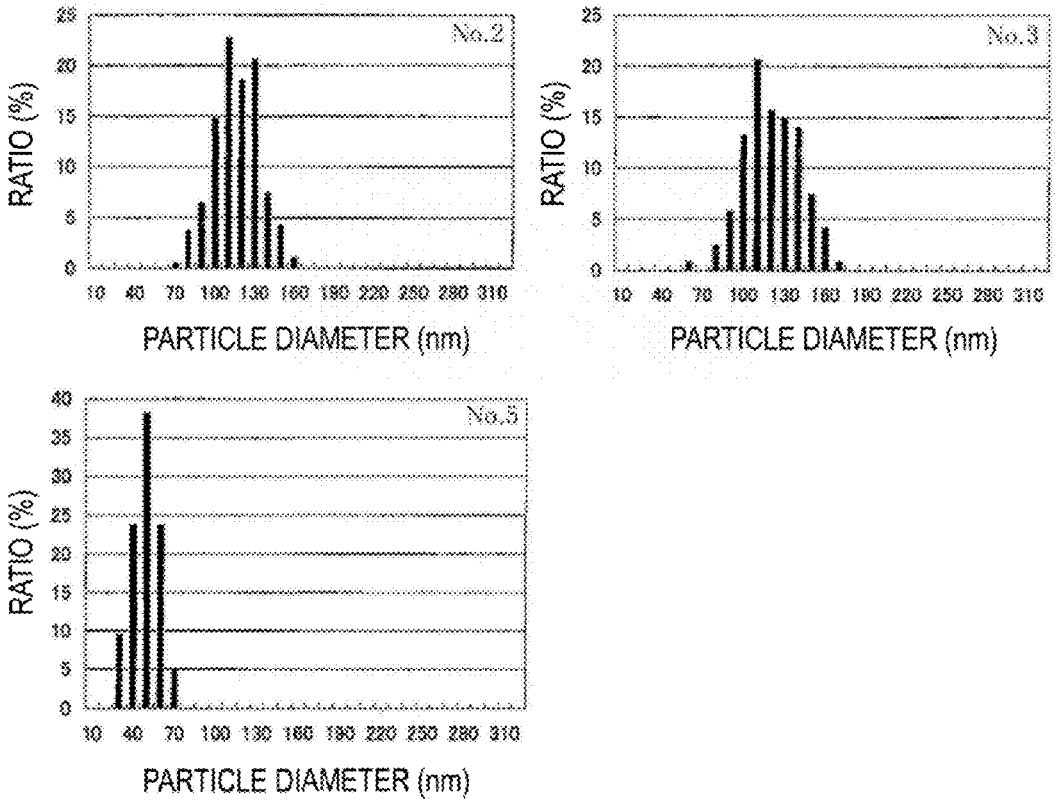
FIG. 9 is a particle size distribution diagram of silver particles of Test Nos. 2 and others according to the first embodiment.
Figure 10:
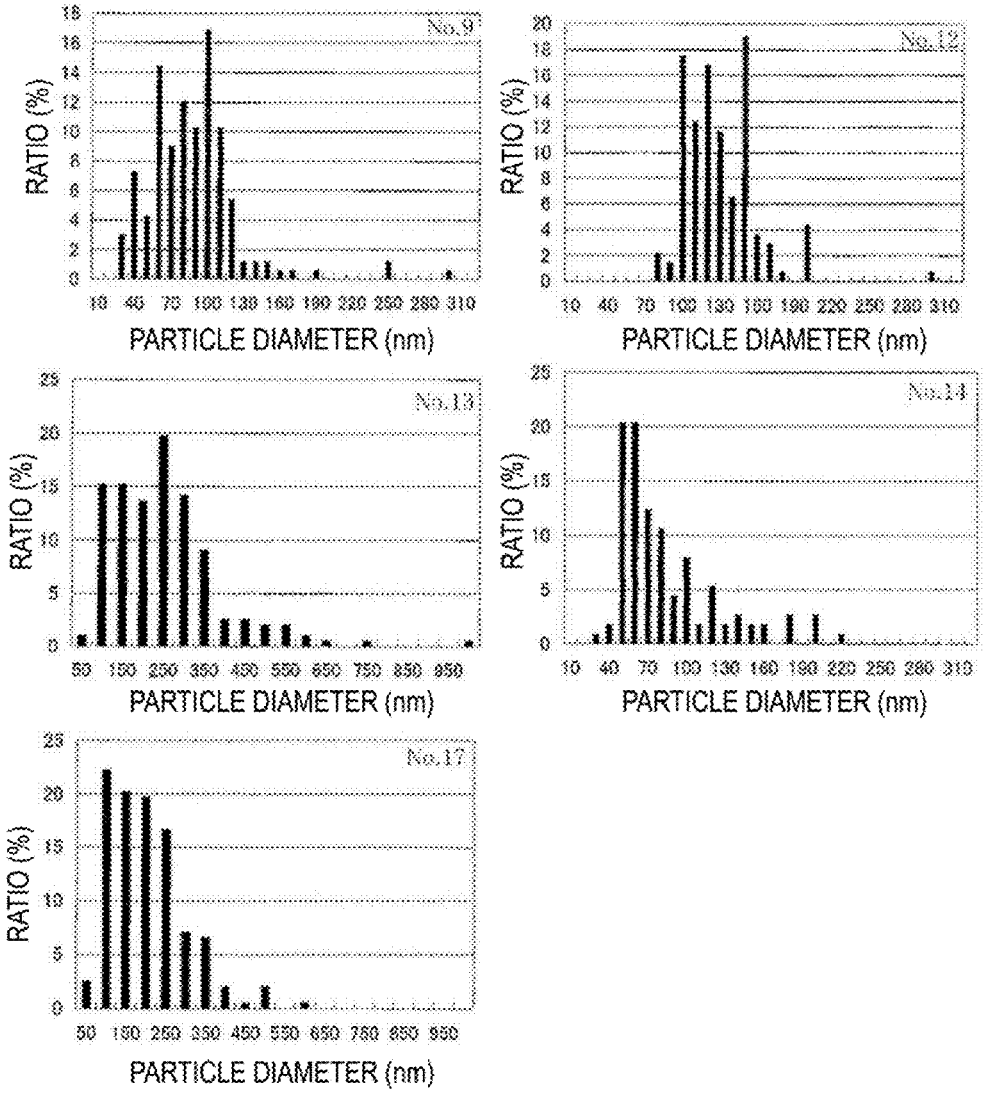
FIG. 10 is a particle size distribution diagram of silver particles of Test Nos. 9 and others according to the first embodiment.
Figure 11:
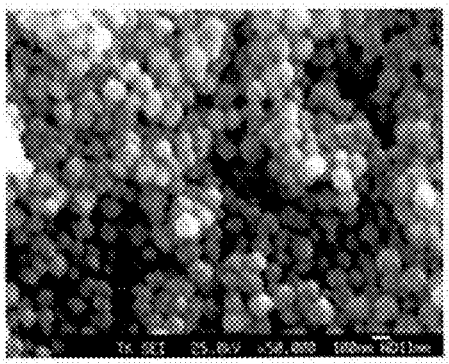
FIG. 11 shows SEM photographs of silver particles of Test Nos. 29 and 30 according to a second embodiment.
Figure 11:
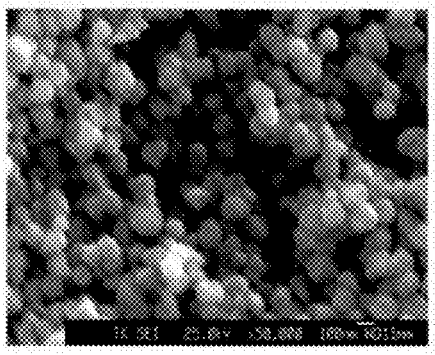
Figure 11:
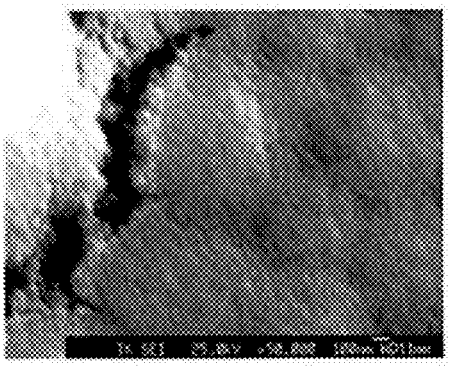
Figure 11:
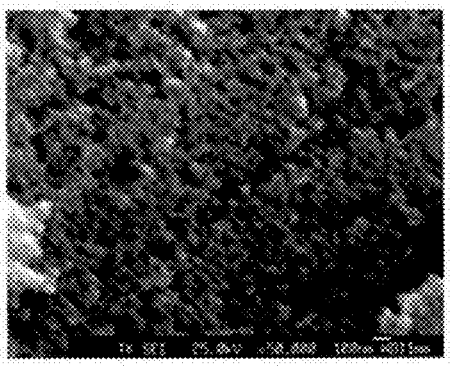

The particle diameter (average particle diameter) and particle size distribution of the recovered silver particles was examined. In this evaluation, SEM observation and photographing were performed on the silver particles, and the particle diameters of the silver particles (about 100 to 200 particles) in images were measured to calculate an average value. Further, a coefficient of variation (CV) was obtained as an index of relative variation in the particle size distribution according to the following equation. A case where the coefficient of variation was 20% or less was designated as "Passing: ○," a case where the coefficient of variation was more than 20% but 30% or less was designated as "Failing: Δ," and a case where the coefficient of variation was more than 30% was designated as "Defective: x." FIG. 9 shows the result "Good (○)" of the particle size distribution, and FIG. 10 shows the result "Failing or Defective (Δ or x)."

Coefficient of variation (%)=(standard deviation/average particle diameter)×100

The evaluation results of the silver particles produced in this embodiment are shown in Table 1 together with the production conditions of the silver particles. Regarding samples shown in the particle size distribution diagrams in FIGS. 9 and 10, the calculation values of the standard deviation and the coefficient of variation are also shown (Table 2).

TABLE 1

| | | Alkylamine | | Homogenizing agent | | | Additive | | Average | |
|---|---|---|---|---|---|---|---|---|---|---|
| Test No. | Silver compound | Type | Mixing, amount*2 | Type | Mixing amount*3 | Amount of water*4 | Type | Added amount*5 | particle diameter | Particle size distribution |
| 1 | Silver oxalate*1 | Hexylamine | 1.5 | DMF + Urea | 1.1 + 1.0 | 47 parts by weight | Oleic acid | 0.023 | — | X |
| 2 | | | 3.0 | | | | | | 115 nm | ○ |
| 3 | | | 6.0 | | | | | | 120 nm | ○ |
| 4 | | | 3.0 | DMF + Urea | 0.05 + 0.05 | 47 parts by weight | Oleic acid | 0.023 | 50 nm | ○ |
| 5 | | | | | 0.1 + 0.1 | | | | 50 nm | ○ |
| 2 | | | | | 1.1 + 1.0 | | | | 115 nm | ○ |
| 6 | | | | | 1.1 + 2.0 | | | | 140 nm | ○ |
| 5 | | | 3.0 | DMF + Urea | 0.1 + 0.1 | 47 parts by weight | Oleic acid | 0.023 | 50 nm | ○ |
| 7 | | | | | 0.41 + 1.0 | | | | 90 nm | ○ |
| 2 | | | | | 1.1 + 1.0 | | | | 115 nm | ○ |
| 8 | | | | | 3.3 + 1.0 | | | | 110 nm | ○ |
| 9 | | | 3.0 | Urea | 1.0 | No water | Oleic acid | 0.023 | 90 nm | X |
| 10 | | | | | | 20 parts by weight | | | 75 nm | ○ |
| 11 | | | | | | 47 parts by weight | | | 80 nm | ○ |
| 12 | | | | | | 100 parts by weight | | | 130 nm | Δ |
| 13 | | | | | | 140 parts by weight | | | 250 nm | X |
| 14 | | | 3.0 | DMF + Urea | 1.1 + 1.0 | No water | Oleic acid | 0.023 | 85 nm | X |
| 15 | | | | | | 20 parts by weight | | | 65 nm | ○ |
| 2 | | | | | | 47 parts by weight | | | 115 nm | ○ |
| 16 | | | | | | 100 parts by weight | | | 100 nm | ○ |
| 17 | | | | | | 140 parts by weight | | | 200 nm | X |
| 18 | | | 3.0 | DMF | 1.1 | 47 parts by weight | Oleic acid | 0.023 | 60 nm | ○ |
| 19 | | | 3.0 | DEF | 0.6 | 20 parts by weight | Oleic acid | 0.023 | 20 nm | ○ |
| 20 | | | 3.0 | DEF + Urea | 0.8 + 1.0 | 47 parts by weight | Oleic acid | 0.023 | 90 nm | ○ |
| 21 | | | 3.0 | No addition | — | No water | No addition | — | <10 nm | N.A.*6 |
| 22 | | Octylamine | 3.0 | DMF + Urea | 1.1 + 1.0 | 47 parts by weight | Oleic acid | 0.023 | 30 nm | ○ |
| 22 | | Hexylamine + Octylamine (mixing ratio: hexylamine:octylamine) | 0 + 3.0 (0:1) | DMF + Urea | 1.1 + 1.0 | 47 parts by weight | Oleic acid | 0.023 | 30 nm | ○ |
| 23 | | | 1.5 + 1.5 (1:1) | | | | | | 75 nm | ○ |
| 24 | | | 3.0 + 1.5 (2:1) | | | | | | 50 nm | ○ |
| 25 | | | 2.1 + 0.9 (7:3) | | | | | | 115 nm | ○ |
| 2 | | | 3.0 + 0 (1:0) | | | | | | 115 nm | ○ |
| 26 | | Hexylamine | 3.0 | DMF + Urea | 1.1 + 1.0 | 47 parts by weight | Oleic acid | No addition | 80 nm | ○ |
| 2 | | | | | | | | 0.023 | 115 nm | ○ |
| 27 | | | | | | | | 0.046 | 140 nm | ○ |
| 28 | | | | | | | | 0.069 | 140 nm | ○ |

*1Regarding silver oxalate (1.5 g), the dry product, or silver oxalate mixed with 0.3 g of water (20 parts by weight) is used.

*2The mixing amount of amine is a ratio of the number of moles of an amino group (mol ($NH_2$)) to the number of moles of silver ions ($Ag^+$) (mol ($Ag^+$)):mol ($NH_2$)/mol ($Ag^+$)

*3The added amount of the homogenizing agent is a ratio of the number of moles of the homogenizing agent (mol (homogenizing agent)) to the number of moles of silver ions (Ag+) (mol (Ag+)):mol (homogenizing agent)/mol (Ag+)

*4The amount of water is part(s) by weight of water when the silver oxalate or silver carbonate is considered to be 100 parts by weight.

*5The added amount of the additive is a ratio of the number of moles of the additive (mol (additive)) to the number of moles of silver ions ($Ag^+$) (mol ($Ag^+$)):mol (additive)/mol ($Ag^+$)

*6Since the silver particles of No. 20 were fine particles, particle size distribution measurement based on SEM photographs was not performed.

TABLE 2

| Test No. | Average particle diameter | Standard deviation | Coefficient of variation | Particle size distribution |
|---|---|---|---|---|
| 2 | 115 nm | 17 nm | 15% | ○ |
| 3 | 120 nm | 21 nm | 18% | ○ |
| 5 | 50 nm | 10 nm | 20% | ○ |
| 9 | 90 nm | 38 nm | 42% | X |
| 12 | 130 nm | 30 nm | 23% | Δ |
| 13 | 250 nm | 134 nm | 54% | X |
| 14 | 85 nm | 40 nm | 47% | X |
| 17 | 200 nm | 97 nm | 49% | X |

* Coefficient of variation (%) = (standard deviation/average particle diameter) × 100

Hereinafter, the contents of Tables 1 and 2 will be described with reference to the particle size distribution diagrams (FIGS. 9 and 10). First, the present invention is based on a thermal decomposition method for producing silver particles by thermal decomposition of a silver-amine complex. However, addition of the homogenizing agent consisting of an organic compound having an amide (carboxylic amide) as a skeleton to the reaction system and the coexistence of a predetermined amount of water in the reaction system are indispensable. For these points, the size of silver particle diameter in No. 21 (anhydrous state with no additive) is dependent on the type of the silver-amine complex to be limited to a minute particle diameter (average particle diameter of less than 10 nm), and thus it is not possible to achieve the object of the present invention that is to obtain silver particles with a target particle diameter ranging from about several tens of nanometers to several hundreds of nanometers. On the other hand, in the case of an appropriate water content with the addition of the homogenizing agent as in Test Nos. 2 to 5, it is possible to obtain silver particles with a uniform particle diameter within an average particle diameter of 20 nm to 150 nm (FIG. 9 and Table 2), and to confirm the effectiveness of the present invention.

Regarding the effect of the homogenizing agent, it is effective in the case of using urea alone (Test Nos. 10 to 12), DMF alone (Test No. 18), and DEF alone (Test No. 19), and a combination thereof (Test Nos. 6 to 8, 20 and the like) is also effective. When the plurality of homogenizing agents are combined, there is also no limitation on the magnitude relationship of the added amount. With the added amount of the homogenizing agent being a molar ratio of 0.1 or more in total, it was confirmed an effect of improving the particle size distribution (Test Nos. 4 to 8). On the other hand, in the case with no addition of the homogenizing agent (Test No. 21), the size of silver particle diameter is dependent on the type of the silver-amine complex to be limited to a minute particle diameter. For this reason, in order to achieve the object of the present invention that is to obtain silver particles with a target particle diameter, it can be said that the addition of the homogenizing agent to some extent is necessary. On the other hand, it is considered that there is no limitation on the upper limit of the added amount of the homogenizing agent.

Further, regarding the content of water in the reaction system, as seen from the results of Test Nos. 9 to 17, although water is necessary as described above, it is possible to confirm that there is also the upper limit of the content of water. The amount of water is a factor of variation in particle diameter as well as a factor of a coarse particle diameter of the silver particles.

Figure 2:
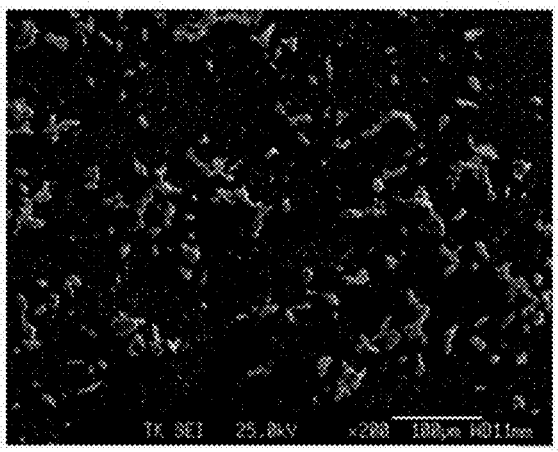
FIG. 2 shows SEM photographs of silver particles of Test Nos. 1 to 3 according to a first embodiment.
Figure 2:
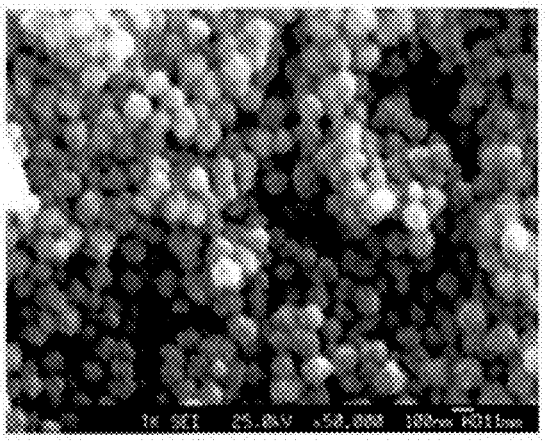
Figure 2:
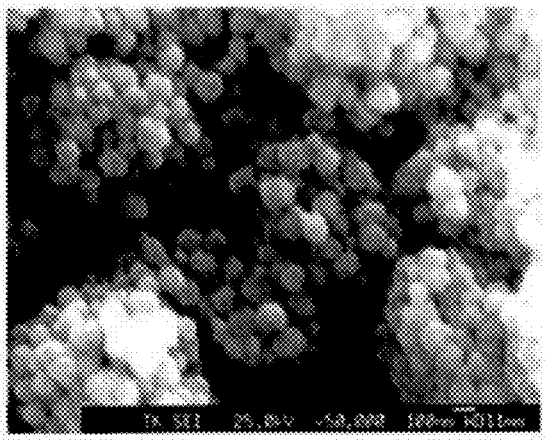
Figure 3:
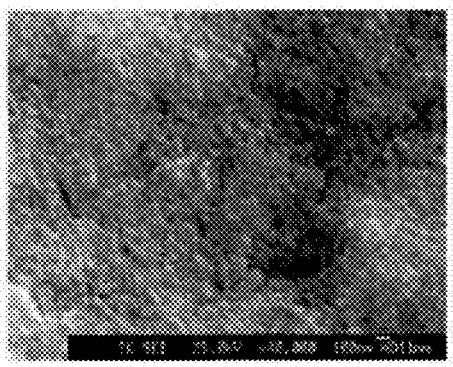
FIG. 3 shows SEM photographs of silver particles of Test Nos. 7 and 8 according to the first embodiment.
Figure 3:
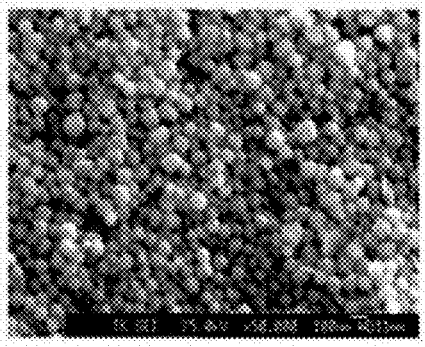
Figure 3:
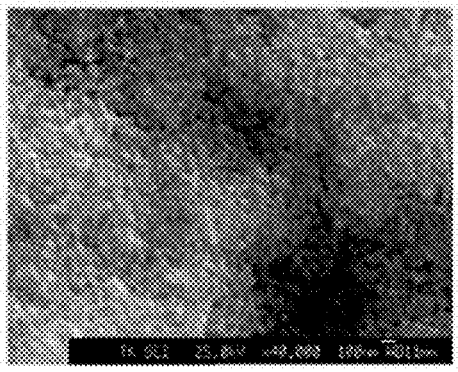
Figure 3:
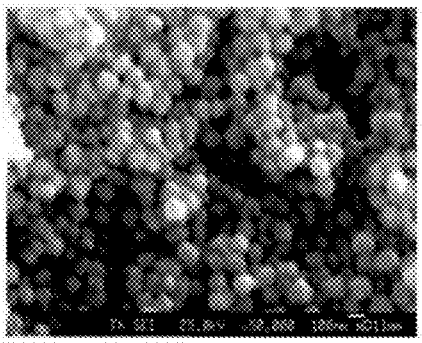
Figure 3:
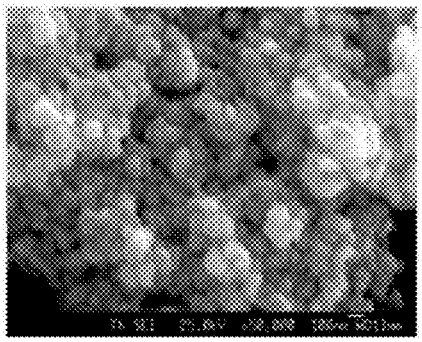
Figure 4:
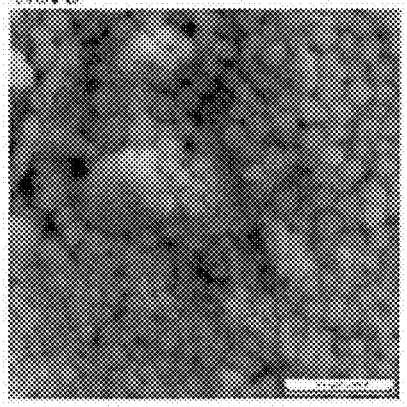
FIG. 4 shows SEM photographs of silver particles of Test Nos. 9 to 13 according to the first embodiment.
Figure 4:
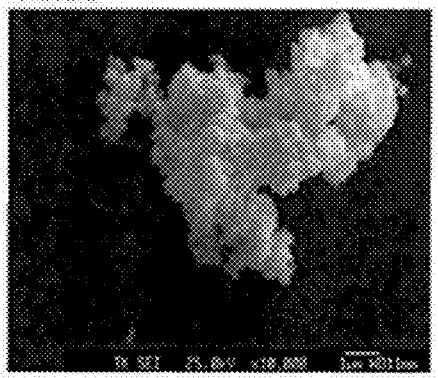
Figure 4:
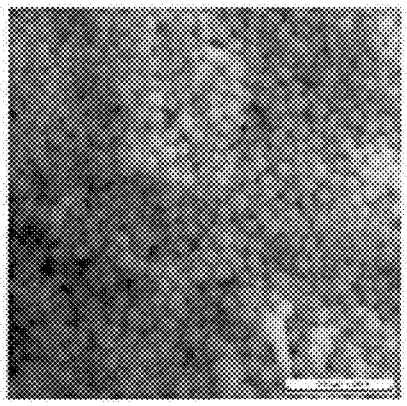
Figure 4:
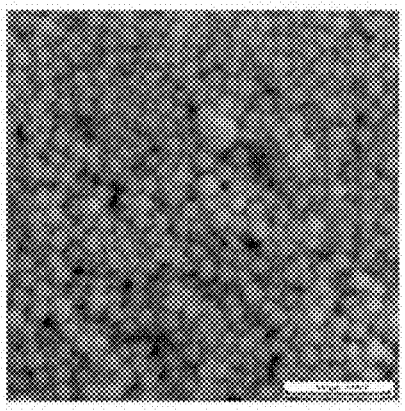
Figure 4:
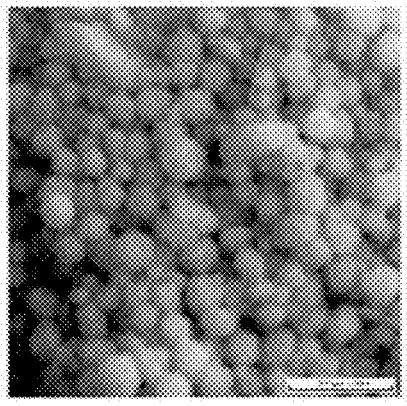
Figure 5:
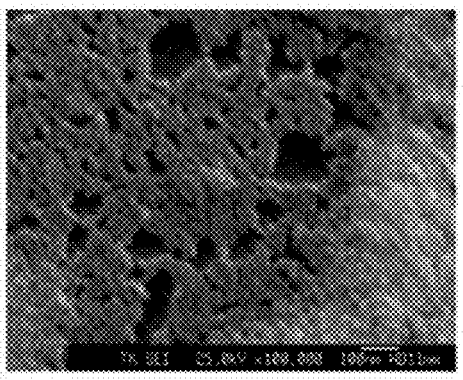
FIG. 5 shows SEM photographs of silver particles of Test Nos. 19 and 20 according to the first embodiment.
Figure 5:
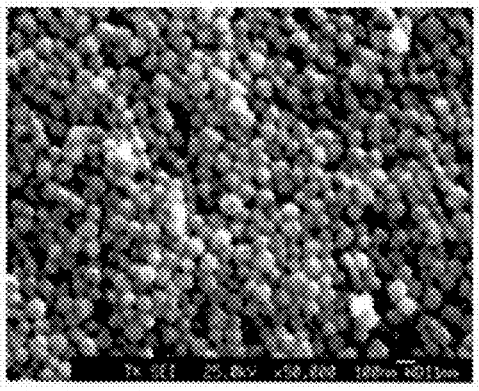
Figure 6:
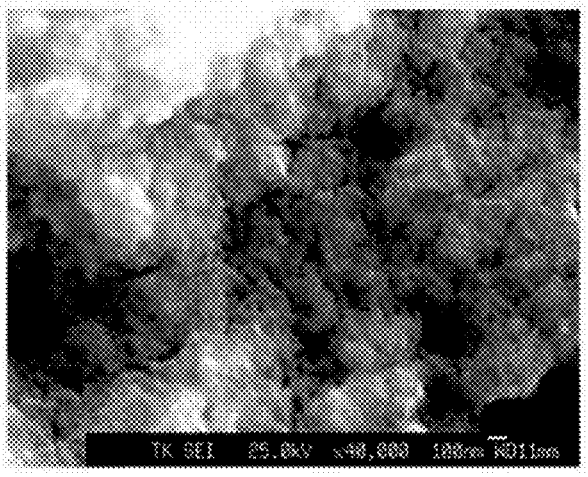
FIG. 6 shows a SEM photograph of silver particles of Test No. 21 according to the first embodiment.
Figure 7:
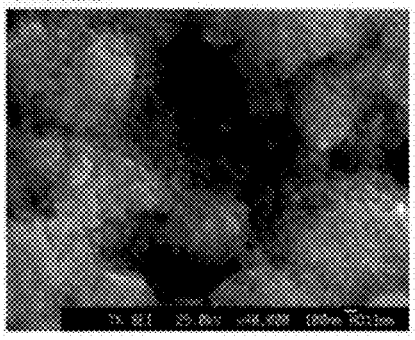
FIG. 7 shows SEM photographs of silver particles of Test Nos. 22 and 24 according to the first embodiment.
Figure 7:
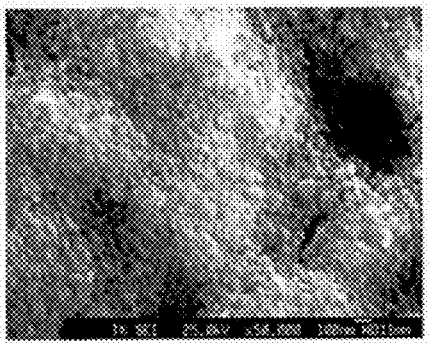
Figure 8:
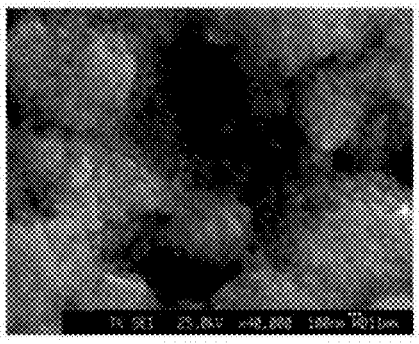
FIG. 8 shows SEM photographs of silver particles of Test Nos. 23 and others according to the first embodiment.
Figure 8:
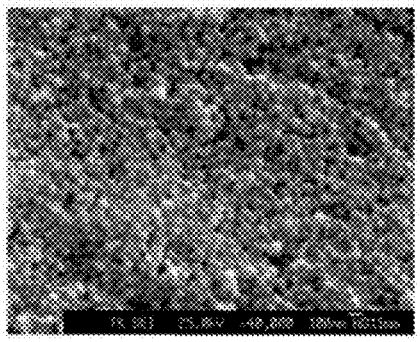
Figure 8:
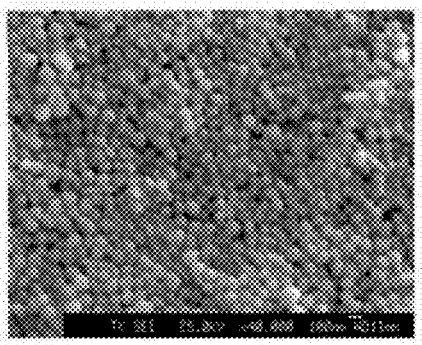
Figure 8:
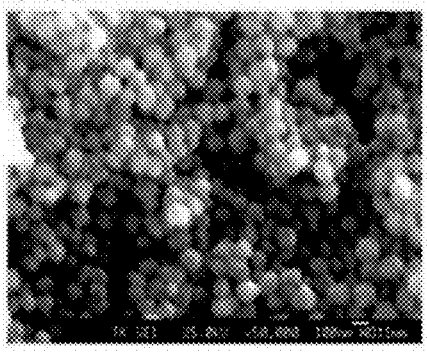

Regarding the amine used for generation of the silver-amine complex, it is possible to confirm the effectiveness of n-hexylamine, n-octylamine, and the mixed amine of n-hexylamine and n-octylamine (Test Nos. 22 to 25). In the case of using octylamine, it was found that silver particles with a fine particles diameter were produced as compared to the case of using n-hexylamine. Further, in the case of using the mixed amine of n-hexylamine and n-octylamine, a high mixing ratio of n-hexylamine results in the production of silver particles with a large particle diameter (Test Nos. 23 to 25). Thus, with use of the mixed amine, silver particles with an intermediate particle diameter are produced. In this embodiment, since the heating rate up to the decomposition temperature is common, it is confirmed that a particle diameter is adjustable by the selection of an amine. Further, the mixing amount of the amine used for generation of the silver-amine complex is preferably set to be a molar ratio of 1.6 or more (Test Nos. 1 to 3). In the case of a molar ratio of 1.5 in No. 1, although most of the silver compound formed a silver-amine complex, unreacted products which do not form a complex were observed in some of the silver compound (FIG. 2).

Incidentally, regarding necessity of oleic acid as an additive, through Test Nos. 26-28, it is confirmed that the addition of an additive such as oleic acid is not indispensable. The oleic acid is considered to be effective for maintaining preferred particle size distribution, but it is possible to produce preferred silver particles without the addition of an additive.

Second Embodiment: As described above, an amine used for generation of the silver-amine complex affects a change in particle diameter of the silver particles, but as a means of adjusting a particle diameter in the present invention, the heating rate of the reaction system is also applicable. In this regard, next, silver particles were produced when the heating rate was changed in Test No. 2 and No. 22 described above. The heating rate in the first embodiment was set to be 10° C./min, but the heating rate of Test No. 2 was set to be 6° C./min (Test No. 29), and the heating rate of Test No. 22 was set to be 1° C./min (Test No. 30) in the second embodiment. The evaluation results on the silver particles produced in the second embodiment are shown in Table 3.

TABLE 3

| | | Alkylamine | | Homogenizing agent | | Amount | | Average | |
|---|---|---|---|---|---|---|---|---|---|
| Test No. | Silver compound | Type | Mixing, amount*2 | Type | Mixing amount*3 | of water*3 | Heating rate | particle diameter | Particle size distribution |
| 2 | Silver | Hexylamine | 3.0 | DMF + | 1.1 + 1.0 | 47 parts | 10° C./min | 115 nm | ○ |
| 29 | oxalate*1 | | | Urea | | by | 6° C./min | 145 nm | ○ |

TABLE 3-continued

| Test No. | Silver compound | Alkylamine Type | Alkylamine Mixing, amount*2 | Homogenizing agent Type | Homogenizing agent Mixing amount*3 | Amount of water*3 | Heating rate | Average particle diameter | Particle size distribution |
|---|---|---|---|---|---|---|---|---|---|
| 22 | | Octylamine | 3.0 | | | weight | 10° C./min | 30 nm | ○ |
| 30 | | | | | | | 1° C./min | 55 nm | ○ |

*1Regarding silver oxalate (1.5 g), the dry product, or silver oxalate mixed with 0.3 g of water (20 parts by weight) is used.
*2The mixing amount of amine is a ratio of the number of moles of an amino group (mol ($NH_2$)) to the number of moles of silver ions ($Ag^+$) (mol ($Ag^+$)):mol ($NH_2$)/mol ($Ag^+$)
*3The added amount of the homogenizing agent is a ratio of the number of moles of the homogenizing agent (mol (homogenizing agent)) to the number of moles of silver ions (Ag+) (mol (Ag+)):mol (homogenizing agent)/mol (Ag+)
*4The amount of water is part(s) by weight of water when the silver oxalate is considered to be 100 parts by weight.

From Table 3, it is found that the particle diameter is adjustable by change of the heating rate. As the heating rate becomes slow, the particle diameter of the silver particles tends to increase (Test nos. 29 and 30). In this way, regarding the particle diameter of target silver particles to be produced, it is possible to adjust the particle diameter by means of different approaches of the selection of an amine and the adjustment of the heating rate in the present invention. Incidentally, even when the heating rate is adjusted in this way, there is no case where preferred particle size distribution is collapsed.

INDUSTRIAL APPLICABILITY

As described above, present invention can produce uniform silver particles while the particle diameter is controlled. Regarding silver particles used in various applications such as electrode or wiring materials, materials for reflective films, catalysts, and antibacterial materials, the present invention can efficiently produce such silver particles with high quality.

The invention claimed is:

1. A method for producing silver particles by use of a thermally-decomposable silver-amine complex as a precursor and heating of a reaction system containing the precursor, comprising:

a process (a): mixing a thermally-decomposable silver compound with an amine to produce a silver-amine complex as a precursor, and to form a reaction system comprising the precursor;

a process (b): adding an organic compound, which has an amide as a skeleton, represented by a following formula to the reaction system

[Chemical Formula 1]

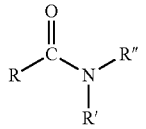

(R is hydrogen, hydrocarbon, an amino group, or a combination thereof; R' and R" are hydrogen or hydrocarbon);

a process (c): setting the water content in the reaction system, wherein the reaction system comprises water and the water content in the reaction system is set at is 20 to 100 parts by weight relative to 100 parts by weight of the silver compound; and a process (d): heating the reaction system, whereby the produced silver particles have diameters such that the ratio of standard deviation of the particle diameters to the average particle diameter is about 0.3 or less.

2. The method for producing silver particles according to claim 1, wherein the thermally-decomposable silver compound in the process (a) is any one of silver oxalate, silver nitrate, silver acetate, silver carbonate, silver oxide, silver nitrite, silver benzoate, silver cyanate, silver citrate, and silver lactate.

3. The method for producing silver particles according to claim 2, wherein the total number of carbon atoms in the amine in the process (a) is 5 to 10.

4. The method for producing silver particles according to claim 2, wherein at least one of urea, a urea derivative, N,N-dimethylformamide, and N,N-diethylformamide is added as the organic compound in the process (b).

5. The method for producing silver particles according to claim 2, wherein the organic compound in the process (b) is added at 0.1 times or more silver ions in the silver compound in terms of a molar ratio.

6. The method for producing silver particles according to claim 2, wherein a heating temperature in the process (d) is equal to or higher than a decomposition temperature of the silver-amine complex.

7. The method for producing silver particles according to claim 1, wherein the total number of carbon atoms in the amine in the process (a) is 5 to 10.

8. The method for producing silver particles according to claim 7, wherein at least one of urea, a urea derivative, N,N-dimethylformamide, and N,N-diethylformamide is added as the organic compound in the process (b).

9. The method for producing silver particles according to claim 7, wherein the organic compound in the process (b) is added at 0.1 times or more silver ions in the silver compound in terms of a molar ratio.

10. The method for producing silver particles according to claim 7, wherein a heating temperature in the process (d) is equal to or higher than a decomposition temperature of the silver-amine complex.

11. The method for producing silver particles according to claim 1, wherein at least one of urea, a urea derivative, N,N-dimethylformamide, and N,N-diethylformamide is added as the organic compound in the process (b).

12. The method for producing silver particles according to claim 11, wherein the organic compound in the process (b) is added at 0.1 times or more silver ions in the silver compound in terms of a molar ratio.

13. The method for producing silver particles according to claim 11, wherein a heating temperature in the process (d) is equal to or higher than a decomposition temperature of the silver-amine complex.

14. The method for producing silver particles according to claim 1, wherein the organic compound in the process (b) is added at 0.1 times or more silver ions in the silver compound in terms of a molar ratio.

15. The method for producing silver particles according to claim 14, wherein a heating temperature in the process (d) is equal to or higher than a decomposition temperature of the silver-amine complex.

16. The method for producing silver particles according to claim 1, wherein a heating temperature in the process (d) is equal to or higher than a decomposition temperature of the silver-amine complex.

17. The method for producing silver particles according to claim 1, further comprising adding water in the reaction system during process (a).

18. The method for producing silver particles according to claim 1, further comprising adding water in the reaction system during process (b).

19. The method for producing silver particles according to claim 1, further comprising adding water in the reaction system during process (c).

20. The method for producing silver particles according to claim 1, further comprising removing water from the reaction system during process (c).

* * * * *